US008142615B2

(12) United States Patent
Wildlock et al.

(10) Patent No.: US 8,142,615 B2
(45) Date of Patent: Mar. 27, 2012

(54) METHOD OF PRODUCING A PAPER PRODUCT

(75) Inventors: Ylva Wildlock, Kungälv (SE); Annette Monica Heijnesson-Hultén, Lerum (SE)

(73) Assignee: Akzo Nobel N.V., Arnhem (NL)

( * ) Notice: Subject to any disclaimer, the term of this patent is extended or adjusted under 35 U.S.C. 154(b) by 55 days.

(21) Appl. No.: 12/519,845

(22) PCT Filed: Nov. 27, 2007

(86) PCT No.: PCT/SE2007/050902

§ 371 (c)(1),
(2), (4) Date: Jul. 15, 2009

(87) PCT Pub. No.: WO2008/076056

PCT Pub. Date: Jun. 26, 2008

(65) Prior Publication Data

US 2010/0024998 A1 Feb. 4, 2010

Related U.S. Application Data

(60) Provisional application No. 60/875,428, filed on Dec. 18, 2006.

(30) Foreign Application Priority Data

Dec. 18, 2006 (EP) ..... 06126413

(51) Int. Cl.
*D21F 11/00* (2006.01)

(52) U.S. Cl. ..... 162/124

(58) Field of Classification Search ..... 162/124, 162/175, 132; 156/277
See application file for complete search history.

(56) References Cited

U.S. PATENT DOCUMENTS

| | | | | |
|---|---|---|---|---|
| 4,913,773 | A | 4/1990 | Knudsen et al. | |
| 5,087,324 | A | 2/1992 | Awofeso et al. | |
| 6,537,680 | B1 | 3/2003 | Norlander et al. | |
| 6,902,649 | B1 | 6/2005 | Satyavolu et al. | |
| 7,018,497 | B2 * | 3/2006 | Ko et al. | 156/181 |
| 2004/0168781 | A1 | 9/2004 | Silenius | |
| 2006/0135676 | A1 | 6/2006 | Greenwood et al. | |

FOREIGN PATENT DOCUMENTS

| | | | |
|---|---|---|---|
| GB | 1 430 760 | | 4/1976 |
| JP | 4-194097 | A | 7/1992 |
| JP | 11-206611 | A | 8/1999 |
| SU | 1 703 752 | A1 | 1/1992 |
| WO | WO 95/26441 | A1 | 10/1995 |
| WO | WO 99/02777 | A1 | 1/1999 |
| WO | WO 99/55965 | A1 | 11/1999 |
| WO | WO 00/14333 | A1 | 3/2000 |
| WO | WO 01/51708 | A1 | 7/2001 |
| WO | WO 01/88269 | A1 | 11/2001 |
| WO | WO 2004/055267 | A1 | 7/2004 |
| WO | WO 2006/041401 | A1 | 4/2006 |
| WO | WO 2006/084883 | A1 | 8/2006 |

OTHER PUBLICATIONS

Patent Abstracts of Japan abstracting JP 4-194097.
Patent Abstracts of Japan abstracting JP 11-206611.
SU 1 703 752 A1 abstract from Questel QPAT dated Jan. 7, 1992.
Russian Office Action with Decision to Grant for Application No. 2009127770 dated Mar. 24, 2011.

* cited by examiner

*Primary Examiner* — Mark Halpern
(74) *Attorney, Agent, or Firm* — Robert C. Morriss

(57) ABSTRACT

The invention relates to a method of producing a laminate paper product comprising at least two layers, said method comprising (i) providing an aqueous suspension comprising cellulosic fibers (ii) adding to the suspension microfibrillar polysaccharide in an amount to yield from about 0.05 to about 50 wt % based on the weight of the cellulosic fibers (iii) dewatering the obtained suspension and forming a first layer having a density from about 150 to about 500 kg/m3 of said laminate paper product. The invention also relates to a method comprising (i) providing an aqueous suspension comprising cellulosic fibers (ii) adding to the suspension microfibrillar polysaccharide in an amount to yield from about 0.05 to about 50 wt % based on the weight of the cellulosic fibers (iii) dewatering the obtained suspension and forming at least a first and a second layer of said laminate whereby at least one of said at least first and second layer is formed from an aqueous suspension obtained in step (ii) containing microfibrillar polysaccharide; and joining said layers in such way that the laminate product obtains a density from about 150 to about 800 kg/m3. The invention also relates to a laminate paper product which can be obtained by the method and the use thereof.

12 Claims, No Drawings

METHOD OF PRODUCING A PAPER PRODUCT

This application is a national stage filing under 35 U.S.C. §371 of PCT/SE2007/050902, filed Nov. 27, 2007, which claims priority to European Patent Application No. 06126413.1, filed Dec. 18, 2006, and U.S. Provisional Patent Application No. 60/875,428, filed on Dec. 18, 2006, the contents of which are incorporated herein by reference in their entirety.

The present invention relates to a method of producing laminate paper products, especially laminates of board. The invention also relates to a laminate paper product which can be obtained by the method, and the use thereof.

BACKGROUND OF THE INVENTION

Today, the development within the papermaking industry is focused on reducing the grammage of paper or board products while maintaining their strength properties. This trend is of high importance of both economical and environmental reasons. In order to produce paper or board products with lower grammage it is of interest to use low density fibers. However, one drawback with those pulp fibers is their poor ability to form strong fiber-fiber bonds which in turn results in insufficient strength properties.

WO 00/14333 relates to a method in which latex is used as a binder in the bulk layer to improve strength properties. However, WO 00/14333 suffers from high amounts of chemicals needed as well as problems related to the application of the latex binder. As an example, if latex is added to the wet end, retention problems of the latex on the fibers may cause deposit problems as well as disturbance of the wet end chemistry balance. Application problems may also occur if latex were added to already formed paper or board layers using existing equipment. Latex may also result in repulpability problems. One object of the present invention is to provide a method of providing low density paper or board laminate products while substantially maintaining the strength and/or stiffness properties. A further object of the present invention is to provide laminated paper or board products which can be repulped without problems in conventional repulpers. A further object is to provide a method of producing a paper or board laminate with improved binding capability of the fibers in at least one inner layer. A further object of the invention is to provide a paper or board laminate which has improved creasability. A further object of the invention is to provide a paper or board laminate in which at least one property of the paper including compression strength, edge wick resistance for hydrogen peroxide, bending resistance index, Z-strength and tensile stiffness index is improved. Particularly, it is an object of the present invention to provide a laminated paper or board, especially a low density laminate or a laminate comprising at least one low density board layer, which has improved compression strength as well as bending stiffness index and/or edge wick resistance.

THE INVENTION

The present invention relates to a method of producing a laminate paper product comprising at least two layers, said method comprising i) providing an aqueous suspension comprising cellulosic fibers ii) adding to the suspension microfibrillar polysaccharide in an amount to yield from about 0.05 to about 50 wt % based on the weight of the cellulosic fibers iii) dewatering the obtained suspension and forming a first layer having a density from about 150 to about 500 kg/m$^3$ of said laminate paper product.

The present invention also relates to a method of producing a laminate paper product comprising at least two layers, said method comprising (i) providing an aqueous suspension comprising cellulosic fibers (ii) adding to the suspension microfibrillar polysaccharide in an amount to yield from about 0.05 to about 50 wt % based on the weight of the cellulosic fibers (iii) dewatering the obtained suspension and forming at least a first and a second layer of said laminate whereby at least one of said at least first and second layer is formed from an aqueous suspension obtained in step (ii) containing microfibrillar polysaccharide; and joining said layers in such way that the laminate product obtains a density from about 150 to about 800 kg/m$^3$.

The paper or board layers formed may be joined by any conventional method including those disclosed in WO 00/14333.

The forming of a layer, e.g. said first layer, involves pressing the formed layer, e.g. by means of press nips which may increase the density of the layer. Pressing may thus be used to control the density of the produced layer(s). Also, the selection of appropriate pulp may be of importance to provide a formed layer of desired density. According to one embodiment, at least one layer can be formed and pressed in a separate stage before being laminated to a further layer. Following the pressing stage, the laminate can be dried in conventional drying equipment such as cylinder dryer with or without dryer wire/felt, air dryer, metal belt etc. Following drying or during the drying process, the laminate can be coated with a further layer.

By the term "laminate paper product" is meant at least two layers of paper and/or board. However, the laminate paper product may also contain further layers of other material than paper and/or board including films of various polymers, e.g. polyethylene, polypropylene, polyester, polyvinyl and/or polyvinylidene chloride, polyvinyl alcohol (PVOH), polyethylene vinyl alcohol co-polymer, ethylene vinyl acetate copolymers and cellulose esters in one or more layers and/or a metallic layer, e.g. an aluminum film, $SiO_x$ (where $0<x<=2$)) deposited polymer films, silica-blended polyvinyl alcohol (PVOH) as further disclosed in US2006/135676 or metallized polymer film which may function as barrier for gases and which may have low or no permeability to water, steam, carbon dioxide, and oxygen. Examples of suitable oxygen barriers include ethylene vinyl alcohol (EVOH), polyvinylidene chloride (PVDC), PAN (polyacrylo nitrile), aluminum, metallized films, e.g. of polypropylene or polyethylene terephthalate, $SiO_x$-deposited films (where $0<x<=2$), inorganic plate-shaped mineral compounded polymers such as clay compounded polymers.

The term "polysaccharide" includes, without limitation, cellulose, hemicellulose, chitin, chitosan, guar gum, pectin, alginate, agar, xanthan, starch, amylose, amylopectin, alternan, gellan, mutan, dextran, pullulan, fructan, locust bean gum, carrageenan, glycogen, glycosaminoglycans, murein, bacterial capsular polysaccharides, and derivatives thereof. The polysaccharide may be used as it is, or spinning may be used to generate or improve fibrous structure.

Microfibrillar cellulose would be the most commonly selected microfibrillar polysaccharide and will therefore be described more in detail herein. Sources of cellulose for the preparation of microfibrillar cellulose include the following: (a) wood fibers, e.g. derived from hardwood and softwood, such as from chemical pulps, mechanical pulps, thermal mechanical pulps, chemical-thermal mechanical pulps, recycled fibers, (b) seed fibers, such as from cotton; (c) seed hull fiber, such as from soybean hulls, pea hulls, corn hulls; (d) bast fibers, such as from flax, hemp, jute, ramie, kenaf, (e) leaf fibers, such as from manila hemp, sisal hemp; (f) stalk or straw fibers, such as from bagasse, corn, wheat; (g) grass fibers, such as from bamboo; (h) cellulose fibers from algae, such as velonia; (i) bacteria or fungi; and (j) parenchymal cells, such as from vegetables and fruits, and in particular sugar beets, and citrus fruits such as lemons, limes, oranges, grapefruits. Microcrystalline forms of these cellulose materials may also be used. Cellulose sources include (1) purified, optionally bleached, wood pulps produced from sulfite, kraft (sulfate), or prehydrolyzed kraft pulping processes and (2) purified cotton linters. The source of the cellulose is not limiting, and any source may be used, including synthetic cellulose or cellulose analogs. According to one embodiment, the microfibrillar polysaccharide such as microfibrillar cellulose is derived from hardwood and/or softwood.

For purposes of the present invention polysaccharide microfibrils refer to small diameter, high length-to-diameter ratio substructures which are comparable in dimensions to those of cellulose microfibrils occurring in nature. While the present specification refers to microfibrils and microfibrillation, these terms are here also meant to include (nano) fibrils with nanometer dimensions (cellulosic or other).

According to one embodiment, the microfibrillar polysaccharide, e.g. microfibrillar cellulose, is modified e.g. by means of grafting, cross-linking, chemical oxidisation, for example by use of hydrogen peroxide, Fenton's reaction, and/or Tempo; physical modification such as adsorption, e.g. chemical adsorption; and enzymatic modification. Combined technologies may also be used to modify microfibrillar cellulose.

Cellulose can be found in nature in several hierarchical levels of organization and orientation. Cellulose fibers comprise a layered secondary wall structure within which macrofibrils are arranged. Macrofibrils comprise multiple microfibrils which further comprise cellulose molecules arranged in crystalline and amorphous regions. Cellulose microfibrils range in diameter from about 5 to about 100 nanometers for different species of plant, and are most typically in the range from about 25 to about 35 nanometers in diameter. The microfibrils are present in bundles which run in parallel within a matrix of amorphous hemicelluloses (specifically xyloglucans), pectinic polysaccharides, lignins, and hydroxyproline rich glycoproteins (includes extensin). Microfibrils are spaced approximately 3-4 nm apart with the space occupied by the matrix compounds listed above. The specific arrangement and location of the matrix materials and how they interact with the cellulose microfibrils is not yet fully known.

According to one embodiment, the polysaccharide is refined or delaminated to such an extent that the final specific surface area (determined by adsorption of $N_2$ at 177 K according to the BET method using a Micromeritics ASAP 2010 instrument) of the formed microfibrillar polysaccharide is from about 1 to about 100, such as from about 1.5 to about 15, or from about 3 to about 10 $m^2/g$. The viscosity of the obtained aqueous suspension of microfibrillar polysaccharide can be from about 200 to about 4000, or from about 500 to about 3000, or from about 800 to about 2500 mPas. The stability, which is a measure of the degree of sedimentation of the suspension, can be from about 60 to 100, such as from about 80 to about 100%, where 100% indicates no sedimentation for a period of at least 6 months.

According to one embodiment, the microfibrillar polysaccharide has an arithmetic fiber length from about 0.05 to about 0.5, for example from about 0.1 to about 0.4, or from about 0.15 to about 0.3 mm. According to one embodiment, the microfibrillar polysaccharide is added to the cellulosic suspension in an amount to yield from about 0.5 to about 30, for example from about 1 to about 15, such as from about 1 to about 10 or from about 2 to 10 wt % based on the weight of the cellulosic fibers.

Non-delaminated wood fibers, e.g. cellulose fibers, are distinct from microfibrillar fibers because the fiber length of wood fibers ranges usually from about 0.7 to about 3 mm. The specific surface area of cellulosic fibers usually is from about 0.5 to about 1.5 $m^2/g$. Delamination can be carried out in various devices suitable for delaminating the fibers of the polysaccharides. The prerequisite for the processing of the fibers is that the device is capable or is controlled in such way that fibrils are released from the fiberwalls. This may be accomplished by rubbing the fibers against each other, the walls or other parts of the device in which the delamination takes place. According to one embodiment, the delamination is accomplished by means of pumping, mixing, heat, steam explosion, pressurization-depressurization cycle, impact grinding, ultrasound, microwave explosion, milling, and combinations thereof. In any of the mechanical operations disclosed herein, it is important that sufficient energy is applied to provide microfibrillar polysaccharide as defined herein.

According to one embodiment, the aqueous suspension to which microfibrillar polysaccharide is added contains cellulosic fibers from chemical pulp, such as sulfate and sulfite pulp, organosolv pulp; recycled fibers; and/or mechanical pulp including e.g. refiner mechanical pulp (RMP), pressurized refiner mechanical pulp (PRMP), pretreatment refiner chemical alkaline peroxide mechanical pulp (P-RC APMP), thermomechanical pulp (TMP), thermomechanical chemical pulp (TMCP), high-temperature TMP (HT-TMP) RTS-TMP, alkaline peroxide pulp (APP), alkaline peroxide mechanical pulp (APMP), alkaline peroxide thermomechanical pulp (APTMP), thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW), chemimechanical pulp (CMP), chemirefinermechanical pulp (CRMP), chemithermomechanical pulp (CTMP), high-temperature CTMP (HT-CTMP), sulfite-modified thermomechanical pulp (SMTMP), reject CTMP (CTMPR), groundwood CTMP (G-CTMP), semichemical pulp (SC), neutral sulfite semi chemical pulp (NSSC), high-yield sulfite pulp (HYS), biomechanical pulp (BRMP), pulps produced according to the OPCO process, explosion pulping process, Bi-Vis process, dilution water sulfonation process (DWS), sulfonated long fibers process (SLF), chemically treated long fibers process (CTLF), long fiber CMP process (LFCMP), and modifications and combinations thereof. The pulp may be a bleached or non-bleached pulp.

Cellulosic fibers can be derived from hardwood, softwood species, and/or nonwood. Examples of hardwood and softwood include birch, beech, aspen such as European aspen, alder, eucalyptus, maple, acacia, mixed tropical hardwood, pine such as loblolly pine, fir, hemlock, larch, spruce such as Black spruce or Norway spruce, and mixtures thereof. Nonwood plant raw material can be provided from e.g. straws of grain crops, wheat straw reed canary grass, reeds, flax, hemp, kenaf, jute, ramie, seed, sisal, abaca, coir, bamboo, bagasse or combinations thereof.

According to one embodiment, the cellulosic fibers of the aqueous suspension are derived from hardwood and/or softwood species.

According to one embodiment, the aqueous suspension to which microfibrillar polysaccharide is added contains cellulosic fibers in an amount from about 0.01 to about 50, for example from about 0.1 to about 25 or from about 0.1 to about 10, or from about 1 to about 10 wt %.

According to one embodiment, the laminate paper product produced is board, paper, or a combination of layers of board and paper.

According to one embodiment, at least one second layer is arranged or joined to said first layer, for example directly or indirectly over substantially the whole surface facing one another. According to one embodiment, the laminate may comprise for example at least three or four layers. The forming of the layers may be performed by any conventional technology.

According to one embodiment, two layers each of which having a density from about 400 to about 1000, e.g. from about 510 to about 770 kg/m$^3$ are joined to said first layer on either side thereof to form outer layers of said laminate paper product.

According to one embodiment, a first layer is produced from a mechanical pulp and the outer layers are produced from a chemical pulp.

According to one embodiment, the first layer, normally constituting an inner layer of the laminate, has a density from about 150 to about 500, such as from about 200 to about 450, for example from about 220 to about 450, such as from about 250 to about 400 kg/m$^3$.

According to one embodiment, at least one outer layer is produced from a chemical pulp obtained in accordance with any of the methods as disclosed herein or other conventional methods for obtaining chemical pulp. The pulps may be bleached or unbleached.

According to one embodiment, a laminate paper product, for example a board such as a liquid packaging board, may comprise at least three layers is formed whereby the product is obtained by joining directly or indirectly an inner layer formed from an aqueous suspension comprising microfibrillar polysaccharide and further layers joined to said inner layer's respective sides, said further layers being produced from an aqueous suspension with or without microfibrillar polysaccharide.

Further layers, e.g. barrier layers, may be formed and joined on the outer layers as defined. Any of the layers can also be coated to improve e.g. edge wick resistance, and printability of the laminate. According to one embodiment, any coated or non-coated layer may in turn be coated with a plastic or polymer layer. Such coating may further reduce liquid penetration and improve heat-sealing properties of the product.

According to one embodiment, at least one layer has a density from about 400 to about 1000, for example from about 500 to about 1000, for example from about 510 to about 1000 such as from about 510 to about 770, or from about 530 to about 700, such as from about 590 to about 670 kg/m$^3$.

According to one embodiment, the first layer is produced from a mechanical and/or chemical pulp obtained from wood or nonwood pulp in accordance with any of the methods as disclosed herein or other conventional methods for obtaining pulp. According to one embodiment, the first layer is produced from at least about 40, e.g. at least about 50, for example at least about 60 or at least about 75 wt % mechanical pulp based on the total pulp weight. The pulps may be bleached or unbleached.

According to one embodiment, the density of the laminate ranges from about 150 to about 800, such as from about 150 to about 700 or from about 200 to about 640, or from about 250 to about 600, such as from about 300 to about 580, or from about 400 to about 500 kg/m$^3$.

According to one embodiment, the laminate is produced in such a way that the grammage of the laminate ranges from about 80 to about 1500, for example from about 150 to about 1000, or from about 200 to about 700 g/m$^2$ is obtained.

According to one embodiment, the aqueous suspension also contains mineral fillers of conventional types, such as, for example, kaolin, clay, titanium dioxide, gypsum, talc and both natural and synthetic calcium carbonates, such as, for example, chalk, ground marble, ground calcium carbonate, and precipitated calcium carbonate. The aqueous suspension can also contain papermaking additives of conventional types, such as drainage and retention chemicals, wet and dry strength agents, sizing agents, such as those based on rosin, ketene dimers, ketene multimers, alkenyl succinic anhydrides, etc.

According to one embodiment, wet and dry strength agents may be added in an amounts from about 0.5 to about 30 kg/t pulp. According to one embodiment, sizing agent(s) may be added in amount from about 0.5 to about 10, such as from about 0.5 to about 4 kg/t pulp. Further paper chemicals may be added to the aqueous suspension in conventional manner and amounts.

According to one embodiment, the invention is applied on paper machines producing wood-containing paper or board and/or paper or board based on recycled fibers, different types of book and newsprint papers, and/or on machines producing nonwood-containing printing and writing papers.

The invention also relates to a laminate paper product obtainable by the method as disclosed herein. The invention further relates to a laminate paper product having improved properties with regard to at least one of the following parameters: edge wick resistance for hydrogen peroxide, compression strength measured according to the Short Compression Test (SCT), bending resistance index, tensile stiffness index, and Z-strength. The laminate paper product may comprise any number of layers as disclosed in the embodiments of the method section and may possess any of the properties including density, grammage etc. as obtained in the method section herein above.

Particularly, the invention concerns a laminate paper product comprising at least two layers, said laminate paper product having a) a density of the laminate ranging from about 150 to about 800 kg/m$^3$, b) an Edge Wick Test (EWT) value for hydrogen peroxide below 6 kg/m$^2$, c) a Short Compression Test (SCT) Index from 20 to about 50 Nm/g.

The invention also concerns a laminate paper product comprising at least two layers, said laminate paper product having a) a density of the laminate ranging from about 150 to about 800 kg/m$^3$, b) a bending resistance index ranging from 20 to about 120 Nm$^6$/kg$^3$, c) a Short Compression Test (SCT) Index from 20 to about 50 Nm/g.

According to one embodiment, at least one of the layers of the laminate comprise microfibrillar polysaccharide in an amount from about 0.05 to about 50, such as from about 0.5 to about 30, or from about 1 to about 15, such as from about 1 to about 10, or from about 2 to about 10 wt % based on the weight of the cellulosic fibers.

However, also several layers of the laminate may contain the amounts defined provided the total amount of microfibrillar polysaccharide in the laminate product does not exceed 50 wt % based on the weight of the cellulosic fibers in the laminate product.

According to one embodiment, the Edge Wick Test (EWT) value for hydrogen peroxide of the laminate is below 6, such as below 5 or 4.5, or below 4 kg/m$^2$. According to one embodiment, the EWT value (hydrogen peroxide) is below 2.5 or 2.2 such as below 2, for example below 1.5 or 1 kg/m$^2$. According to one embodiment, the EWT value (hydrogen peroxide) is at least 0.1 kg/m$^2$, for example at least 0.2 kg/m$^2$.

According to one embodiment, the laminate paper product has a bending resistance index ranging from about 10 to about 120, e.g. from about 14 to about 40, e.g. from about 17 to about 40, such as from 20 to about 40 or from 20 to about 25, e.g. from 21 to 24 Nm$^6$/kg$^3$.

According to one embodiment, the Z-strength of the laminate ranges from about 150 to about 500, e.g. from about 175 to about 450, such as from about 185 to about 400, or from about 190 to about 350, or from about 200 to about 320 kPa.

According to one embodiment, the tensile stiffness index of the laminate is from about 5 to about 20, e.g. from about 5 to about 15, or from about 5 to about 10 kNm/g.

According to one embodiment, the tensile index ranges from about 20 to about 100 such as from about 30 to about 70, or from about 40 to about 60 Nm/g.

According to one embodiment, the compression strength of the laminate according to the Short Compression Test (SCT) Index ranges from 20 to about 50, such as from 20 to about 40, for example from 20 to about 30, or 20.4 to about 25 Nm/g.

According to one embodiment, the Scott Bond ranges from about 50 to about 500, e.g. from about 100 to about 250, such as from about 130 to about 220 J/m$^2$.

The laminate paper product may comprise further layers including plastic or polymer layers coated on a paper or board layer and/or barrier layers as disclosed herein.

Particularly, the invention relates to the use of laminate paper products for use as packaging board, in particular for use as storage containers for aqueous, fatty and/or dry food (according to definition in FDA 176.170 and 176.180). Such food products may include rice, cereal (dry food), as well as milk, juice, hot liquids etc (liquids). The laminate paper product may also be used for e.g. cigarette packages, tools (spare parts), pharmaceuticals, soap etc. Further examples of applications include the production of paper products including multilayered paper and/or board, wrapping and packaging material for goods such as industrial goods or as an intermediate product for manufacture of such end products or other laminate paper products. The packages should protect the contents from the surrounding environments including impacts during handling, transportation and storing, against the pressure of stacking and extreme temperatures and moisture.

The invention being thus described, it will be obvious that the same may be varied in many ways. The following examples will further illustrate how the described invention may be performed without limiting the scope of it.

All parts and percentages refer to part and percent by weight, if not otherwise stated. All amounts of microfibrillar polysaccharide or microfibrillar cellulose given in percent by weight are based on the weight of the cellulosic fibers.

The following standard methods were used to characterize the properties of the laminates as defined herein including the following examples:

| Parameter | Standard method | Equipment |
|---|---|---|
| Grammage | ISO 536:1995 | |
| Paper density, thickness | ISO 534:1988 | |
| Tensile properties (tensile stiffness, tensil strength) | ISO 1924-2 | Alwetron TH1 (L&W) |
| Z-strength | SCAN-P-80:98 | L&W ZD Tensile tester |
| Bending Resistance Index 15° | ISO 2493:1992 | L&W |
| Geometrical Bending Resistance | ISO 2493:1992 | |
| Scott Bond | Tappi T 833 pm-94 | Scott Internal bond tester |
| SCT (Short Compression Test) | ISO 9895:1989 | L&W Compressive strength tester STFI |

Relative creasing strength is obtained by comparing the bending resistance measured in MD (Machine Direction) and CD (Cross Direction) according to ISO 2493:1992, before and after creasing.

In order to measure edge wick resistance of a paper product, the Edge wick test method for hydrogen peroxide was employed and performed according to the following procedure:

Equipment

Waterbath, metal boxes, grid, 3M Scotch tape, tape applicator.

Chemicals

Hydrogen Peroxide 35%, stored at maximum +8° C.

Experimental

1. Paper samples should be conditioned for at 23° C. and 50% relative moisture content for at least 2 hours.
2. Thickness of sample is measured according to ISO 534: 1988.
3. Samples are taped using the applicator and cut to 25×75 mm in series with 5 samples/point.
4. Samples are weighed.
5. 5 samples are placed in the metal box containing 35% hydrogen peroxide.

The metal box is before this placed in a water bath at a temperature of +70° C. (±1.0° C.). A specially designed grid is placed in the box in order to keep the samples on the bottom of the box. The samples should be 10 cm below the surface of the hydrogen peroxide. When the samples have been placed in the box, the lid is closed and a timer is started.

6. After 10 minutes (±15 s) the samples are taken out of the box and are blotted using a blotting paper.
7. Samples are weighed.

Calculations and Reporting $w_1$=weight before (mg)

$w_2$=weight after (mg)

t=thickness (μm)=average of 5 measurements

O=circumference=0.2 m n=number of samples=5

$$\text{Edgewick index} = \frac{w_2 - w_1}{t \times O \times n} = (\text{kg/m2})$$

Reproducibility

Accurate results may be obtained from the method at especially high degrees of hydrophobicity including Edge Wick Test values below 2.0 kg/m$^2$. Below this limit, double samples should not differ by more than ±10% for laboratory-made sheets and ±5% for machine-made sheets.

EXAMPLE 1

A) A paper product was produced wherein the top and back layers had the same composition as a commercial board with a grammage of 60 g/m$^2$ from a mixture of 60% hardwood (°SR 26) and 40% softwood kraft pulp fibers (°SR 23) using a dynamic sheet former (Formette Dynamic, supplied by Fibertech AB, Sweden). Paper sheets were formed in the Dynamic Sheet Former by pumping the stock (pulp consistency: 0.5%, conductivity: 1500 μm/s, pH 7) from the mixing chest through a traversing nozzle into the rotating drum onto the water film on top of the wire, draining the stock to form a sheet, pressing and drying the sheet. The amounts of chemicals added to the suspension (based on the weight of pulp) and addition time (in seconds) prior to pumping and sheet formation were the following:

| Time (s) | Amount (%) | Product | Chemical |
|---|---|---|---|
| 180 | 0 | | MFC |
| 120 | 0.13 | Eka WS XO | PAAE, (polyamidamineepichlorohydrin |
| 60 | 0.1 | Eka DR 28HF | AKD, (alkyl ketene dimer) |
| 45 | 0.6 | Raisamyl 142 | Cationic potato starch |
| 30 | 0.03 | Eka PL1510 | Cationic polyacrylamide |
| 15 | 0.05 | NP320 | Silica sol |
| 0 | | | Pumping |

The dewatering time was 75 s. The paper sheets were pressed at 3 bars in a roll press and thereafter dried restrained in a plane drier at 105° C. for 8 minutes.

B) Top and back layers of a board with a grammage of 56 g/m$^2$ and 53 g/m$^2$ respectively were prepared as in A), but with addition of microfibrillar cellulose in various amounts and having the following characteristics: arithmetic fiber length: 0.25 mm (Kajaani FS-100 Fiber Size Analyzer), specific surface area 5 m$^2$/g (BET method using a Micromeritics ASAP 2010 instrument); viscosity: 1098 mpas (Brookfiled viscometer, RV 3, 12 rpm); stability: 100% (sedimentation degree of a 0.5% pulp suspension); Water Retention Value (WRV): 5.39 (g/g) (SCAN:-C 62:00).

Top and back layers prepared according to A) and B) were analyzed for their grammage, tensile strength, and tensile stiffness. From Table 1, it can be seen that the tensile strength for boards produced from stocks to which 3 to 10% microfibrillar cellulose was added had about the same or higher tensile strength than boards produced from a stock without addition of microfibrillar cellulose even though the grammage were 53 and 56 g/m$^2$, i.e. lower than the reference (60 g/m$^2$). Similar observation can be made in view of tensile stiffness (see Table 1).

TABLE 1

| Grammage (g/m$^2$) | MFC (%) | Tensile strength (kN/m) | Tensile stiffness (kN/m) |
|---|---|---|---|
| 60 | 0 | 4.63 | 350 |
| 56 | 0 | 4.11 | 323 |

TABLE 1-continued

| Grammage (g/m$^2$) | MFC (%) | Tensile strength (kN/m) | Tensile stiffness (kN/m) |
|---|---|---|---|
| 56 | 3 | 4.51 | 338 |
| 56 | 6 | 4.89 | 388 |
| 56 | 10 | 5.02 | 426 |
| 53 | 0 | 3.91 | 298 |
| 53 | 3 | 4.33 | 331 |
| 53 | 6 | 4.56 | 354 |
| 53 | 10 | 4.79 | 368 |

EXAMPLE 2

A) A paper product was produced wherein the inner layer had the same composition as a commercial board with a grammage of 130 g/m$^2$ from a mixture of CTMP-pulp (CSF 400), pulped broke, and softwood kraft pulp (°SR 23) fibers with different ratios (A1-A4, see Table 2) using a dynamic sheet former (Formette Dynamic, supplied by Fibertech AB, Sweden). Paper sheets were formed as in Example 1. The amounts of chemicals added to the suspension (based on the weight of pulp including pulped broke) and addition time (in seconds) prior to pumping and sheet formation were as in Example 1, but with 0.35% AKD. The sheets were drained, pressed and dried as in example 1, but with 11 minutes drying in the plane dryer.

TABLE 2

| Sample | CTMP (%) | Pulped broke (%) | Softwood kraft pulp (%) |
|---|---|---|---|
| A1 | 60 | 20 | 20 |
| A2 | 65 | 20 | 15 |
| A3 | 70 | 20 | 10 |
| A4 | 75 | 20 | 5 |

B ) The inner layer of a board having a grammage of 130 g/m$^2$ was prepared as in A but from a pulp mixture consisting of 75% CTMP-pulp, 20% pulped broke and 5% softwood kraft to which additions of microfibrillar cellulose in amounts from 2 to 8% were made (B1-B4).

C ) The inner layer of a board having a grammage of 130 g/m$^2$ was prepared as in A) but from a pulp mixture consisting of 75% HT-CTMP-pulp (CSF 700), 20% pulped broke and 5% softwood kraft to which additions of microfibrillar cellulose in amounts from 2 to 8% were made (C1-C4).

The inner layers of the boards prepared according to A-C were analyzed for their tensile index and Z-strength properties. It is evident from Table 3 that the density of the inner layer of the board can be reduced while substantially maintaining the tensile index and the Z-strength of the reference A by adding microfibrillar cellulose in combination with an increased amount of CTMP, especially HT-CTMP to form the inner layer.

TABLE 3

| Sample | MFC (%) | Density kg/m$^3$ | Tensile index (Nm/g) | Z-strength kPa |
|---|---|---|---|---|
| A1 | 0 | 339 | 40.9 | 256 |
| A2 | 0 | 335 | 38.3 | 248 |
| A3 | 0 | 318 | 35.1 | 209 |
| A4 | 0 | 275 | 29.6 | 144 |
| B1 | 2 | 279 | 31.8 | 188 |
| B2 | 4 | 287 | 32.9 | 214 |
| B3 | 6 | 301 | 37.7 | 254 |

TABLE 3-continued

| Sample | MFC (%) | Density kg/m$^3$ | Tensile index (Nm/g) | Z-strength kPa |
|---|---|---|---|---|
| B4 | 8 | 337 | 44.2 | 311 |
| C1 | 2 | 268 | 32.0 | 180 |
| C2 | 4 | 282 | 35.0 | 222 |
| C3 | 6 | 291 | 37.4 | 250 |
| C4 | 8 | 310 | 41.9 | 282 |

EXAMPLE 3

A) A paper product was produced with the same composition as a commercial board with a total grammage of 250 g/m$^2$ using a dynamic sheet former. Top and bottom layers, each 60 g/m$^2$, were prepared from a pulp mixture of 60% hardwood (°SR 26) and 40% softwood kraft pulp fibers (°SR 23). The inner layer, 130 g/m$^2$, was prepared from a mixture of 60% CTMP (CSF 400), 20% pulped broke and 20% softwood kraft pulp fibers. Paper sheets were formed in the Dynamic Sheet Former as in Example 1, however, no drainage of the stock was performed between formation of the different layers. The amounts of chemicals added to the suspension (based on the weight of pulp) and addition time (in seconds) prior to pumping and sheet formation were the same as in Examples 1 and 2. The drainage time of the three-layer board was 90 seconds. The paper sheets were pressed at 3 bars in a roll press and thereafter dried restrained in a plane drier at 105° C. for 15 minutes.

B ) A three-layer board having a total grammage of 215 g/m$^2$, top and bottom layers having a grammage of 53 g/m$^2$ and an inner layer of 109 g/m$^2$ were prepared as in A) but with addition of microfibrillar cellulose. The amounts of microfibrillar cellulose added to top and back layers were 2%, while the paper chemicals were added as in A) in Example 1. The inner layer was produced from a pulp comprising 75% HT-CTMP (CSF 700), 20% pulped broke, and 5% softwood kraft pulp fibers to which 3% microfibrillar cellulose was added.

C) A three-layer board having a total grammage of 215 g/m$^2$ was prepared as in B) but the inner layer was prepared from a fiber mixture of 80% HT-CTMP (CSF 700) and 20% pulped broke to which 5% microfibrillar cellulose was added.

The boards produced according to A-C were analyzed for their density, tensile strength, Z-strength and geometrical bending resistance (see Table 4).

TABLE 4

| Sample | Grammage (g/m$^2$) | Density (kg/m$^3$) | Tensile Strength (kN/m) | Z-Strength (kPa) | Geometrical Bending Resistance (Nm) |
|---|---|---|---|---|---|
| A | 250 | 463 | 14.8 | 261 | 447 |
| B | 215 | 421 | 13.9 | 206 | 433 |
| C | 215 | 392 | 13.3 | 167 | 485 |

The results presented in Table 4 show that the geometrical bending resistance is essentially maintained or improved while the tensile strength is essentially maintained in samples B and C compared to reference A despite the fact that samples B and C have a much lower grammage and density.

Boards produced according to A-C were coated (laminated) and analyzed for their density, bending resistance index, edge wick (hydrogen peroxide), and relative creasing strength in machine (MD) and cross direction (CD). By comparing coated and non-coated samples (see Table 5) it can be seen that lamination of the boards with polyethylene increases the density and thus reduces the bending resistance index for all boards. However, it is still evident that an increased bending resistance index can be obtained for boards B and C produced by addition of microfibrillar cellulose to the stock compared to the reference A. Furthermore, a favourable reduction in relative creasing strength and edge wick properties (Table 5) of the laminated boards according to the invention can also be seen. When the edge wick is reduced (B and C) compared to reference A, the liquid resistance at the edges is strengthened.

TABLE 5

| | Density (kg/m$^3$) | | Bending Resistance Index (Nm$^6$/kg$^3$) | | Edge Wick (HP) (kg/m$^2$) | Relative Creasing Strength (%) | |
|---|---|---|---|---|---|---|---|
| Sample | Uncoated | Coated | Uncoated | Coated | Coated | MD | CD |
| A | 514 | 546 | 26.2 | 24.7 | 7.0 | 78 | 78 |
| B | 458 | 513 | 34.5 | 28.4 | 3.7 | 72 | 74 |
| C | 461 | 512 | 34.7 | 28.5 | 4.5 | 66 | 75 |

EXAMPLE 4

A ) Laminate paper products were produced with a total grammage of 150, 200, 250 and 300 g/m$^2$ respectively using a dynamic sheet former (Formette Dynamic, supplied by Fibertech AB, Sweden). Top and bottom layers, each 55 g/m$^2$, were prepared from a pulp mixture of 60% hardwood (°SR 26) and 40% softwood (°SR 23) kraft pulp fibers. Inner layers, 40, 90, 140 and 190 g/m$^2$, respectively, were prepared from a pulp mixture of 70% CTMP (CSF 400) and 30% softwood kraft pulp fibers. Paper sheets were formed in the Dynamic Sheet Former as in Examples 1 and 3, however, with the following amounts of chemicals added to the suspension (based on the weight of pulp) and addition times (in seconds) prior to pumping and sheet formation:

| Time (s) | Outer layer (%) | Middle layer (%) | Product | Chemical |
|---|---|---|---|---|
| 150 | 0 | 0 | | MFC |
| 90 | 0.2 | 0.5 | Eka DR 28HF | AKD, (alkyl ketene dimer) |
| 30 | 0.6 | 1.0 | PB970 | Cationic potato starch |
| 15 | 0.03 | 0.03 | NP442 | Colloidal silica sol |
| 0 | | | Pumping | |

In order to reach density values around 600 kg/m$^3$, the products were pressed in a plane press according to the following; the laminate of 150 g/m$^2$ at 8.5 bar for 5 minutes, the laminate of 200 g/m$^2$ at 10 bar for 5 minutes, the laminate of 250 g/m$^2$ at 13 bar for 5 minutes and the laminate of 300 g/m$^2$ at 13 bar for 7 minutes.

B ) Paper products were produced with total grammages of 150, 200, 250 and 300 g/m$^2$, respectively as in A) with inner layers (40, 90, 140 and 190 g/m$^2$) prepared from a mixture of 78% HT-CTMP (CSF 740) and 22% softwood kraft pulp fibers. The amount of microfibrillar cellulose added to the inner layers was 5%, while the wet end chemicals were added as in A). The paper products were pressed as in A).

C) Paper products were produced with a total grammage of 150, 200, 250 and 300 g/m$^2$, respectively as in B) but with inner layers (40, 90, 140 and 190 g/m$^2$) prepared from a pulp mixture of 83% HT-CTMP (CSF 740) and 17% softwood kraft pulp fibers. The amount of microfibrillar cellulose added to the middle layers was 5%, while the wet end chemicals were added as in A). The paper products were pressed as in A).

The boards produced according to A-C were analyzed for their density, tensile index, Z-strength and bending resistance index (see Table 6).

TABLE 6

| Grammage | Density kg/m$^3$ | | | Tensile index Nm/g | | | Z-strength kPa | | | Bending Resistance Index Nm$^6$/kg$^3$ | | |
|---|---|---|---|---|---|---|---|---|---|---|---|---|
| g/m$^2$ | A | B | C | A | B | C | A | B | C | A | B | C |
| 150 | 603 | 582 | 564 | 77.6 | 77.2 | 73.4 | 454 | 392 | 356 | 22.0 | 23.6 | 25.4 |
| 200 | 592 | 524 | 534 | 69.7 | 71.1 | 70.6 | 478 | 340 | 397 | 23.6 | 30.8 | 31.0 |
| 250 | 599 | 520 | 531 | 67.9 | 65.5 | 64.8 | 475 | 355 | 364 | 21.6 | 30.5 | 28.9 |
| 300 | 583 | 534 | 523 | 64.6 | 61.1 | 61.0 | 419 | 350 | 370 | 21.3 | 24.2 | 26.4 |

The results presented in table 6 show that the bending resistance index is essentially improved while the tensile strength is essentially maintained in samples B and C compared to reference A despite the fact that samples B and C have lower densities.

EXAMPLE 5

A) A paper product was produced on a multiply board pilot machine. Two outer layers were produced on two fourdriniers and the inner layer using a secondary head box in front of a hybrid former. All three head boxes used during the trial were hydraulic head boxes. The press section layout was a double-felted roll press followed by a double-felted shoe press. After the press section the paper was rolled and then dried for 3-4 hours on an off-line four cylinder drier.

The outer layers, each 55 g/m$^2$, were prepared from a pulp mixture of 60% bleached softwood (°SR 23) and 40% bleached hardwood (°SR 26). Before sheet formation the following chemicals were added to the pulp suspension: 0.2% Eka DR 28HF (AKD, Alkyl ketene dimer), 0.6% Perbond 970 (cationic potato starch), 0.03% Eka NP 442 (colloidal silica sol).

The inner layer consisted of 70% CTMP(CSF 400) and 30% softwood. The grammage of the inner layer was approximately 100 g/m$^2$. Before sheet formation the following wet end chemicals were added: 0.5% Eka DR 28HF (AKD, Alkyl ketene dimer), 1.0% Perbond 970 (cationic potato starch), 0.03% Eka NP 442 (colloidal silica sol).

B) A paper product was produced according to A, but with an inner layer consisting of 70% HT-CTMP (CSF 740) and 30% softwood.

C) A paper product was produced according to B, but with an addition of 2% microfibrillar cellulose to the inner layer before addition of wet end chemicals as set out in A).

D) A paper product was produced according to B, but with an addition of 5% micro fibrillar cellulose to the inner layer before addition of wet end chemicals as set out in A).

E) A paper product was produced according to D. To the aqueous suspension for forming the outer layers, 2% microfibrillar cellulose was added before the addition of wet end chemicals. The amount of wet end chemicals added to the outer layers was the same as in A), but with 0.06% Eka NP 442.

The boards produced according to A-E were analyzed for their strength properties and edge wick using hydrogen peroxide (see Table 7).

TABLE 7

| Paper Property | Unit | A | B | C | D | E |
|---|---|---|---|---|---|---|
| Grammage | g/m$^2$ | 205 | 207 | 210 | 217 | 207 |
| Density | kg/m$^3$ | 609 | 530 | 537 | 549 | 575 |
| Tensile Index | Nm/g | 52.4 | 48.7 | 43.8 | 50.3 | 51.7 |

TABLE 7-continued

| Paper Property | Unit | A | B | C | D | E |
|---|---|---|---|---|---|---|
| Tensile Stiffness Index | kNm/g | 5.9 | 5.7 | 5.6 | 5.6 | 6.0 |
| Bending Resistance Index | Nm$^6$/kg$^3$ | 17.4 | 23.8 | 23.8 | 20.4 | 20.9 |
| Z-Strength | kPa | 423 | 181 | 223 | 258 | 306 |
| Scott Bond | J/m$^2$ | 244 | 133 | 125 | 177 | 211 |
| SCT Index | Nm/g | 23.8 | 19.8 | 20.4 | 20.5 | 22.7 |
| Edge Wick (HP) | kg/m$^2$ | 5.5 | 2.5 | 2.0 | 2.0 | 1.9 |

The invention claimed is:

1. A method of producing a laminate paper product comprising at least two layers, said method comprising (i) providing an aqueous suspension comprising cellulosic fibers (ii) adding to the suspension microfibrillar polysaccharide in an amount to yield from about 0.05 to about 50 wt % based on the weight of the cellulosic fibers (iii) dewatering the obtained suspension and forming at least a first and a second layer of said laminate whereby at least one of said at least first and second layer is formed from an aqueous suspension obtained in step (ii) containing microfibrillar polysaccharide; and joining said layers in such way that the laminate product obtains a density from about 150 to about 800 kg/m$^3$, wherein the paper product is board.

2. The method according to claim 1, wherein microfibrillar polysaccharide is added to the suspension in an amount to yield from about 1 to about 15 wt % based on the weight of cellulosic fibers.

3. The method according to claim 1, wherein the cellulosic fibers are derived from a mechanical pulp.

4. The method according to claim 1, wherein the first layer has a density from about 220 to about 450 $kg/m^3$.

5. The method according to claim 1, wherein the microfibrillar polysaccharide is microfibrillar cellulose.

6. The method according to claim 5, wherein the microfibrillar cellulose is modified by means of grafting, cross-linking, chemical oxidisation, physical and/or enzymatic modification.

7. The method according to claim 1, wherein the microfibrillar polysaccharide has a specific surface area from about 1 to about 100 $g/m^2$.

8. The method according to claim 1, wherein the microfibrillar polysaccharide has an arithmetic fiber length from about 0.05 to about 0.5 mm.

9. The method according to claim 1, further comprising joining a second layer to said first layer, wherein the second layer has a density from about 400 to about 1000 $kg/m^3$.

10. The method according to claim 1, further comprising joining two layers having a density from about 400 to about 1000 $kg/m^3$ to said first layer on either side thereof to form outer layers of said paper product.

11. The method according to claim 10, wherein said first layer is produced from mechanical pulp and the outer layers are produced from chemical pulp.

12. The method according to claim 1, wherein the laminate paper product is a liquid packaging board.

* * * * *